United States Patent [19]

Gipson

[11] Patent Number: 5,027,903

[45] Date of Patent: Jul. 2, 1991

[54] COILED TUBING VELOCITY STRING HANGOFF METHOD AND APPARATUS

[76] Inventor: Thomas C. Gipson, P.O. Box 231, 1-20 East, Cisco, Tex. 76437

[21] Appl. No.: 554,248

[22] Filed: Jul. 17, 1990

[51] Int. Cl.[5] ..... E21B 19/22; E21B 21/00; E21B 33/03

[52] U.S. Cl. ..... 166/382; 166/77; 166/298; 166/384

[58] Field of Search ..... 166/382, 384, 77, 298, 166/297, 55, 55.1

[56] References Cited

U.S. PATENT DOCUMENTS

| | | | |
|---|---|---|---|
| 3,690,381 | 9/1972 | Slator et al. | 166/384 |
| 3,791,447 | 2/1974 | Smith et al. | 166/384 X |
| 3,920,076 | 11/1975 | Laky | 166/384 |
| 4,621,403 | 11/1986 | Babb et al. | 166/77 X |
| 4,844,166 | 7/1989 | Goin , III et al. | 166/77 X |
| 4,856,590 | 8/1989 | Caillier | 166/384 X |

*Primary Examiner*—Stephen J. Novosad
*Attorney, Agent, or Firm*—Thomas E. Sisson

[57] ABSTRACT

A method and apparatus for hanging off a coiled tubing velocity string in an existing, active gas production well. The method allows for the "hot" tapping into a charged coiled tubing run thereby eliminating the need for an end plug and blow out equipment on site. A sealed cutter assembly is connected to the hangoff assembly, the charged coiled tube is cut, and back pressure leakage is avoided by the use of a hangoff head which seals in two directions. The cutter assembly is removed and the coiled tubing velocity string is piped to a new sales line.

1 Claim, 11 Drawing Sheets

COILED TUBING VELOCITY STRING HANGOFF METHOD AND APPARATUS

BACKGROUND OF THE INVENTION

The present invention relates to an improved method and apparatus for hanging off a coiled tubing (CT) velocity string in an existing production well.

It is well known that liquid loading in gas wells is a problem which results in decreased gas production and in some cases complete cessation of production, i.e., what is known as a "kill". The gas flowing characteristics of a well may be affected by the normal production from gas reservoirs of condensate or water naturally occurring in the formation. If these liquids are not carried to the surface by the gas they will eventually load up in the downhole tubing and cut off the flow of gas. This occurs when there is insufficient transport energy in the gas phase to overcome the head of liquid in the tubing.

By running a line of smaller diameter CT into the existing production tubing string, a reduction in the gas flow area will result in an increased gas flow velocity sufficient to overcome the critical production velocity (C.P.V.). Thus, there has been considerable interest in methods for more economically (both in terms of time and material costs) hanging off the CT in the existing production string, particularly without having to kill the well. (See Wesson and Shursen, "Coiled Tubing Velocity Strings Keep Wells Unloaded," p. 56–60, WORLD OIL (July 1989)).

Current hangoff methods normally involve the following steps:

a. Setting up necessary rigging;
b. Installing a CT hanger/packoff assembly on the existing production string;
c. Installing a pumpout plug into the end of the CT to allow the CT to be run into the well while it is flowing without gas or liquid entering the CT;
d. Running the CT to the desired depth;
e. Energizing the packoff in the hanger/packoff assembly;
f. Installing and setting slips on the CT;
g. Cutting off the excess and removing the CT above the cut;
h. Installing valves and other flow plumbing;
i. Connecting nitrogen source to CT and blowing out the plug in the downhole end of the CT.
j. Disconnecting nitrogen source and placing well on production through the CT velocity string.

Alternatively, if there is a need to initially blow out fluid in the production string, then the CT may be run into the string without the plug, but attached to a nitrogen source. After the nitrogen source is activated and the well fluids blown out, the CT must be retracted and the end plug placed in the CT. This is an extra step requiring additional time and cost.

As may be seen the current methods require the insertion of the downhole end plug which must be pumped out after the CT is run to the desired depth and cut off and this necessitates having a pumpout gas (nitrogen) and delivery system available on site. The method and apparatus of the present invention eliminates this costly and time-consuming step by allowing the operator to "hot tap" the CT which is loaded with gas or liquid after being inserted into the wellbore.

SUMMARY OF THE INVENTION

The present invention makes use of a unique hangoff head and cutter assembly which in combination enables the operator to run the CT into the wellbore through the existing production string without a plug and to subsequently cut off the excess CT without exposing the operator to the pressurized gas and fluid in the CT velocity string.

BRIEF DESCRIPTION OF THE DRAWINGS

In describing the invention in detail, reference is had to the accompanying drawings, forming a part of this specification, and wherein like numerals of reference indicate corresponding parts throughout the several views in which.

DETAILED DESCRIPTION OF THE PREFERRED EMBODIMENT

Figure 1:
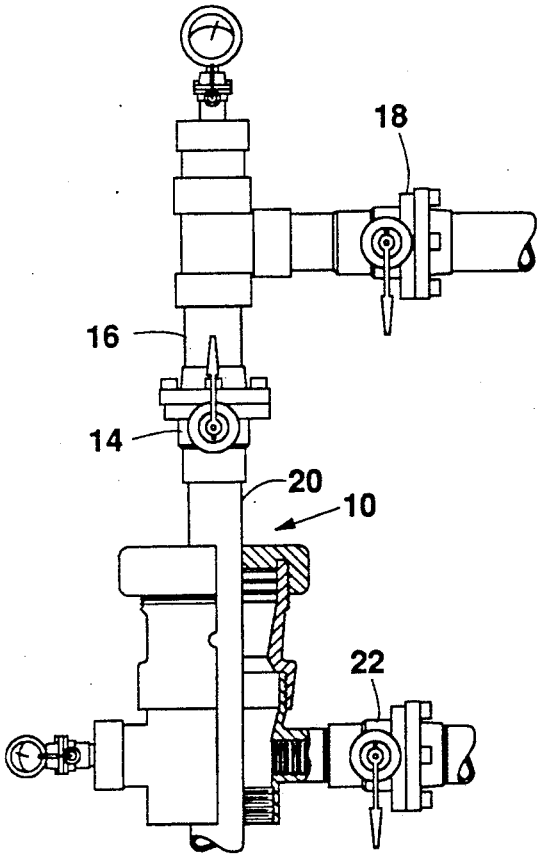
FIG. 1 illustrates a typical existing gas well head.

FIG. 1 illustrates a typical existing well head 10 (gas well) prior to the installation of the coiled tubing velocity string. Gas 12 is shown in these illustrations by use of dotted areas. Master valve 14 is open and gas 12 is shown in production tubing 16 up to valve 18 which is shown closed to an existing sales line 20. Large annulus valve 22 is shown closed.

In the method of the present invention, the well should be shut in for a period of time sufficient to achieve a maximum pressure buildup and, in addition, to minimize the fluid level. Soap sticks dropped into the well before shut-in have been found to aid in fluid removal up through the velocity string after its installation.

Figure 2:
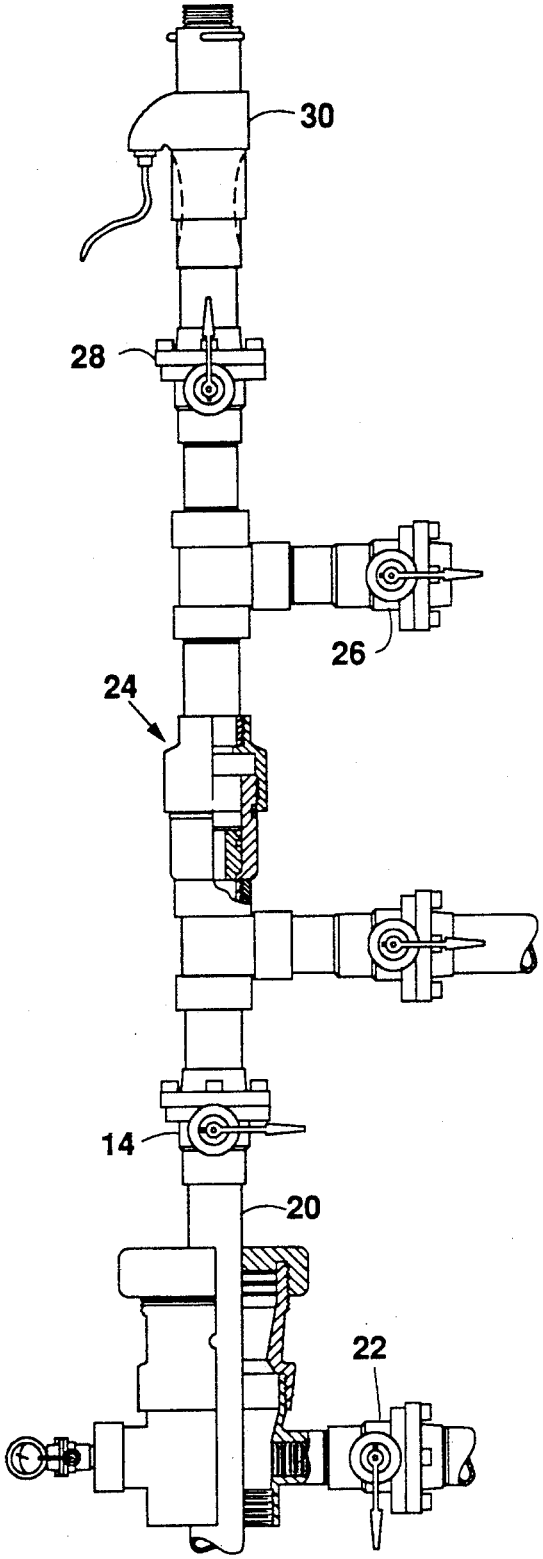
FIG. 2 illustrates the initial hangoff assembly of the present invention.

The initial hangoff assembly of the present invention is illustrated in FIG. 2. Master valve 14 is closed and the hangoff head 24 of the present invention has been installed between master valve 14 and sales valve 18. Further added to the piping as part of the hangoff assembly are side valve (or second line valve) 26, top valve 28, and hydraulic packoff valve 30.

Figure 3:
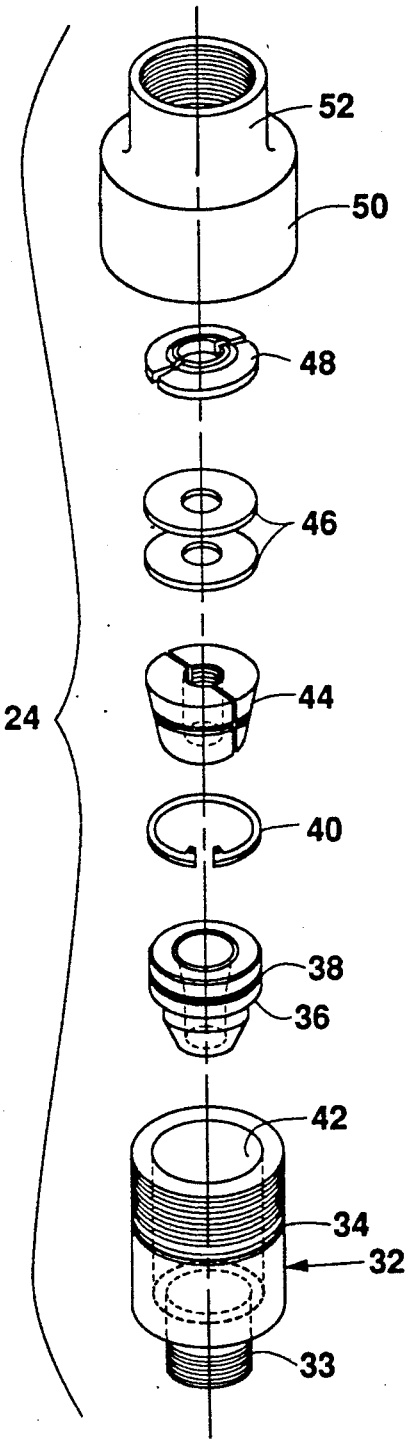
FIG. 3 illustrates the details of the hangoff head of the present invention.

A detailed illustration of hangoff head 24 is shown in FIG. 3. Body 30 is provided with a first threaded end 33 for connection to said master valve piping and outer grooves to receive and retain back pressure O-rings 34. O-rings 34 serve an important function in the present invention in that they provide a sealing function once the CT is severed and gas or fluid fills the hangoff assembly. Body 30 has a second upper end which is threaded to secure cap 50 to the body 30. Stripper rubber member 36 with O-ring 38 fits into the inner portion 42 of body 30. FIG. 3 also illustrates the snap ring 40, slip bowl 43, slips 44, split rubber packing 46, split steel ring 48, and cap 50. Cap 50 has a thread neck 52 for connection to the piping to second line valve 26. Thus, hangoff head 24 is unlike any known in the art. It is capable of handling pressures directed to either side of rubber packing 36 and is threaded on both ends 33 and 52.

Figure 4:
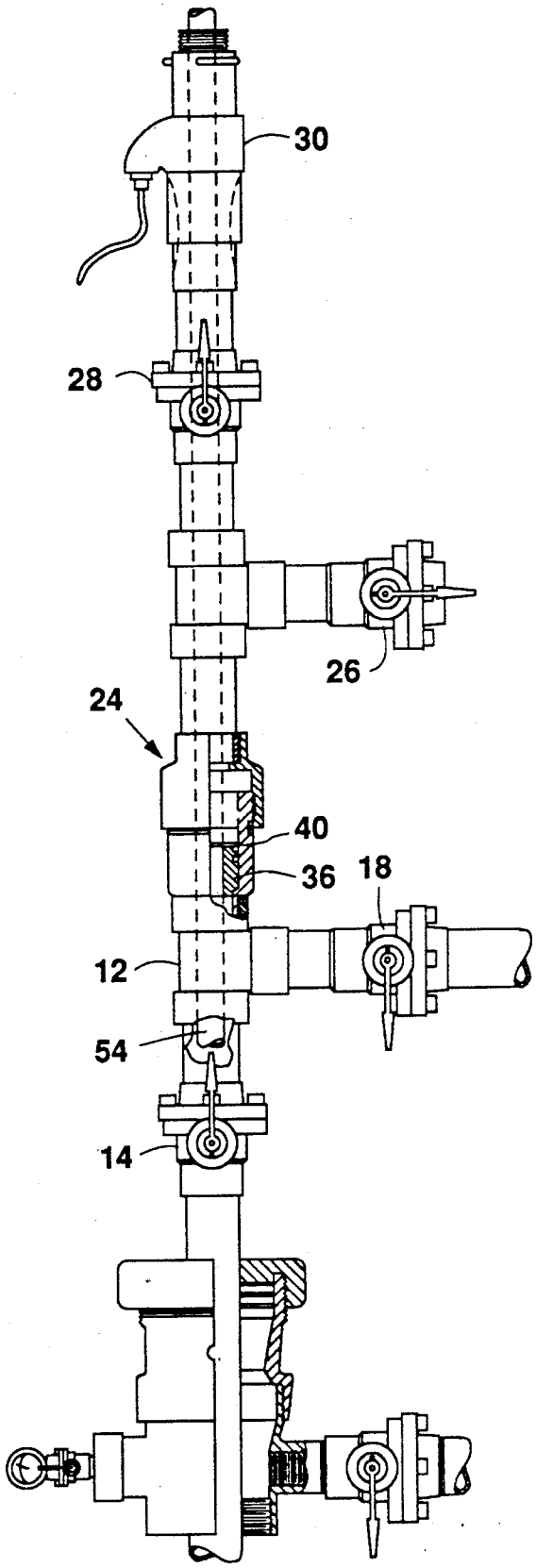
FIG. 4 illustrates the CT run to the top of the master valve in the present invention.

Coiled tubing 54 is shown in FIG. 4 without a plug in its downhole end. CT 54 has been run down through open hydraulic packoff valve 30, through hangoff head 24, and through stripper rubber member 36. Thus, when master valve 14 is opened CT 54 is in fluid communication with the existing production tubing run and pressurized up through CT 54 to the coiled tubing unit (not shown). Gas 12 is sealed off from side valve 26 by the seals in hangoff head 24.

Figure 5:
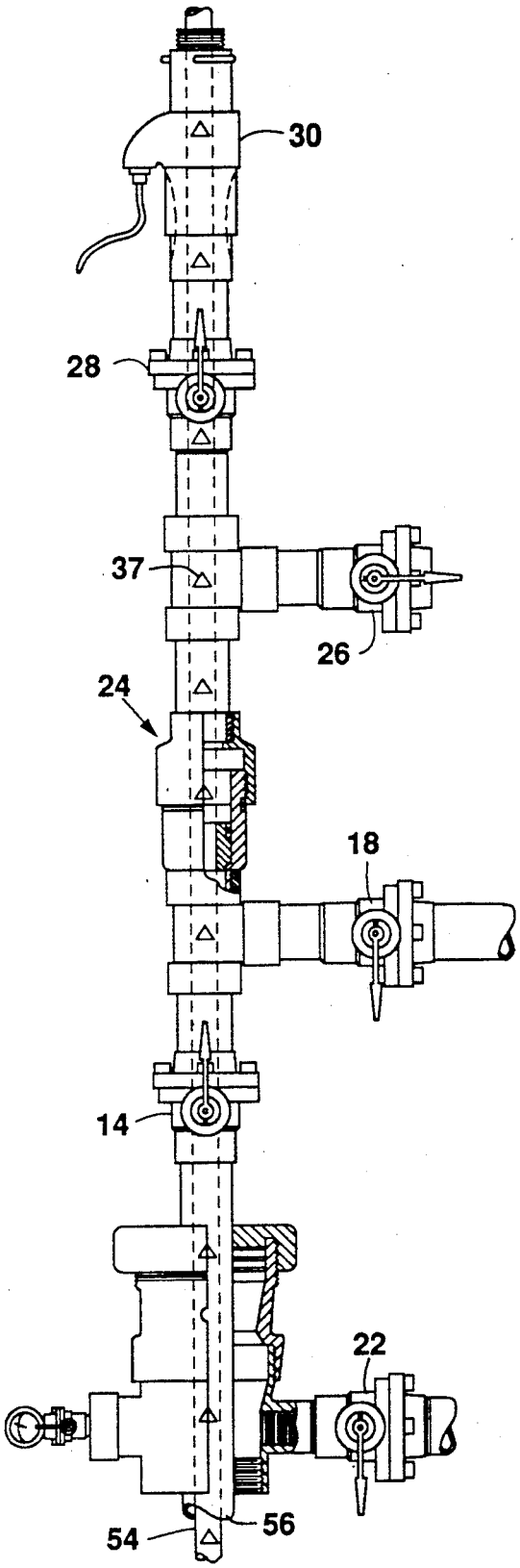
FIG. 5 illustrates the step of running CT to the desired depth in the existing production tube in the present invention.
Figure 6:
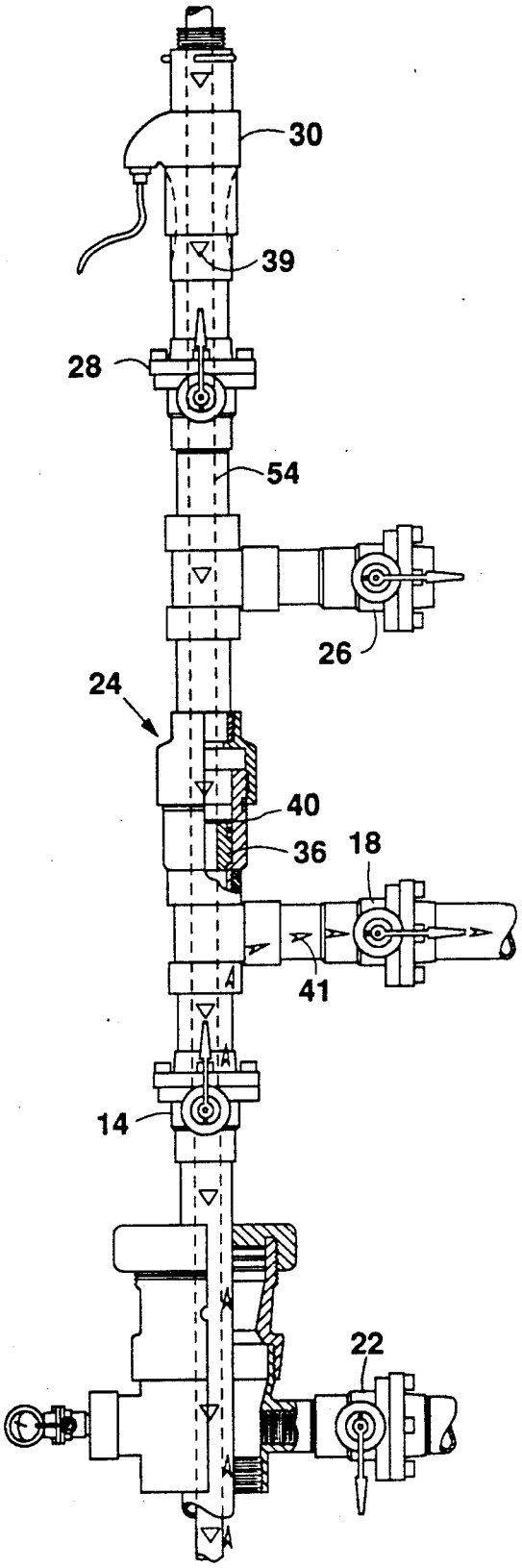
FIG. 6 illustrates the step of cleanout prior to hangoff in the present invention.

FIG. 5 illustrates that CT 54 has been run down through the existing production string 56 to the desired depth into the well tubing run producing gas and fluids 37 through the CT 54 to the coiled tubing unit (not shown). To clean out the well prior to hangoff of the velocity string, nitrogen, fluid, and air (or foam air) 39 may be pumped through CT 54 driving discharge fluids 41 through valve 18 as shown in FIG. 6. This step may be eliminated if cleanout is not desired or if cleanout equipment is not available at the well site.

Figure 7:
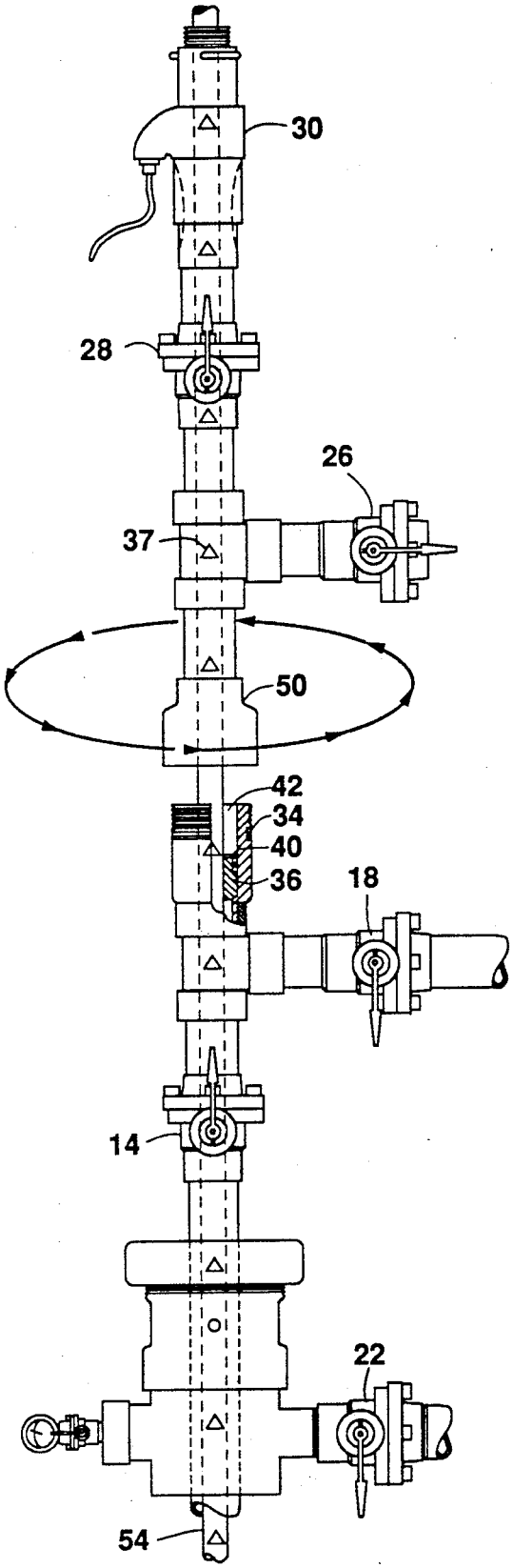
FIG. 7 illustrates the initial step in hangoff in the present invention.
Figure 8:
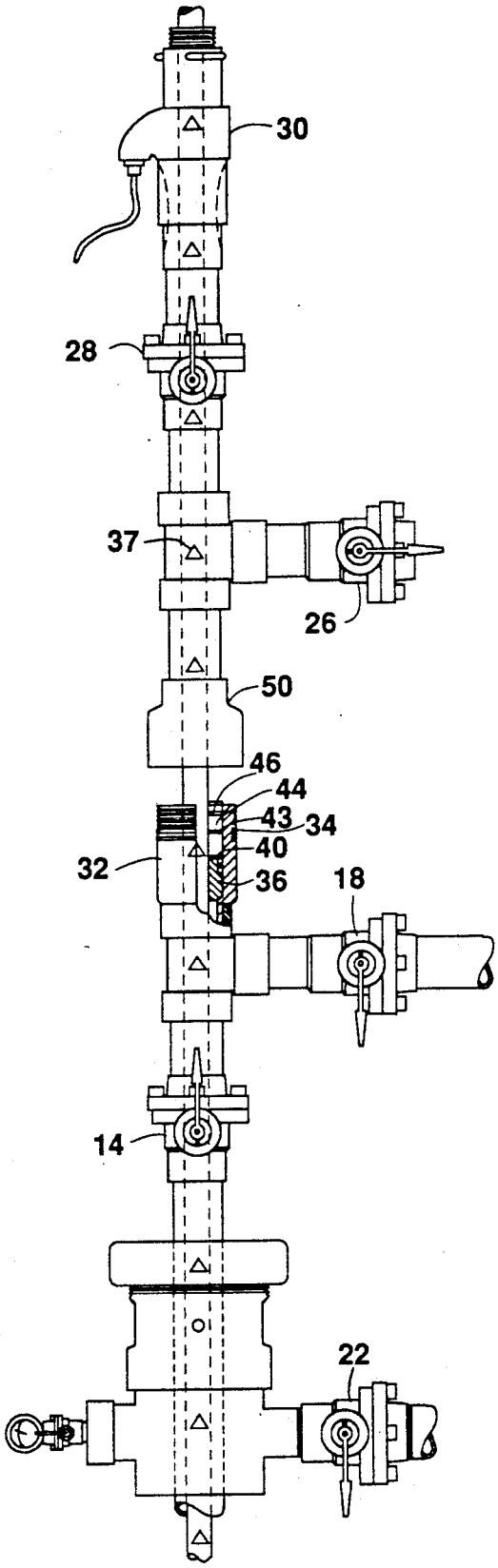
FIG. 8 installation of slips in the present invention.

Once hangoff is desired (the desired depth having been reached), cap 50 may be rotated to unscrew and elevate it as shown in FIG. 7. Valve 18 has been closed and fluid and gas 37 flow up CT 54. Slip bowl 42 is ready to receive and retain slips 44 as shown in FIG. 8. In FIG. 8 snap ring 40 is installed, slips 44 inserted with O-ring 43 and split rubber top packing 46 completing the packoff. When cap 50 is reverse rotated it is tightened onto body 32, the CT 54 is then held and suspended in the production string. Cap 50 is in sealing engagement with seals 34 in body member 32.

Figure 9:
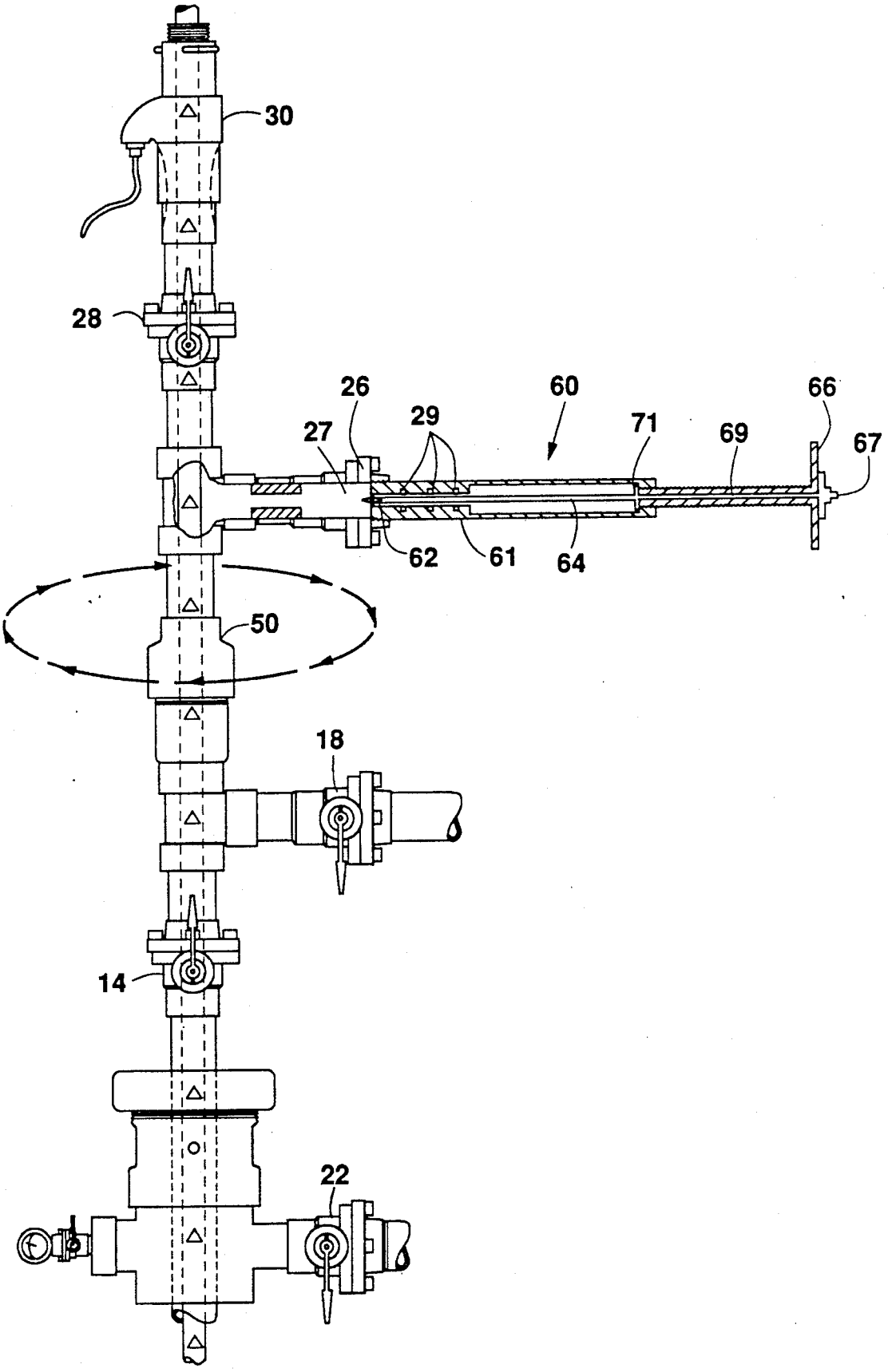
FIG. 9 illustrates the replacement of the cap and installation of the cutter assembly of the present invention.

FIG. 9 illustrates the replacement of cap 50 and the installation of the cutter assembly 60. Side valve 26 now becomes the cutter valve through which cutter wheel 62 and stem 64 must pass as discussed below. The opening 27 in valve 26 is sufficient to allow cutter wheel 62 to twist as handle 66 is rotated to advance stem 64 toward CT 54.

Figure 10:
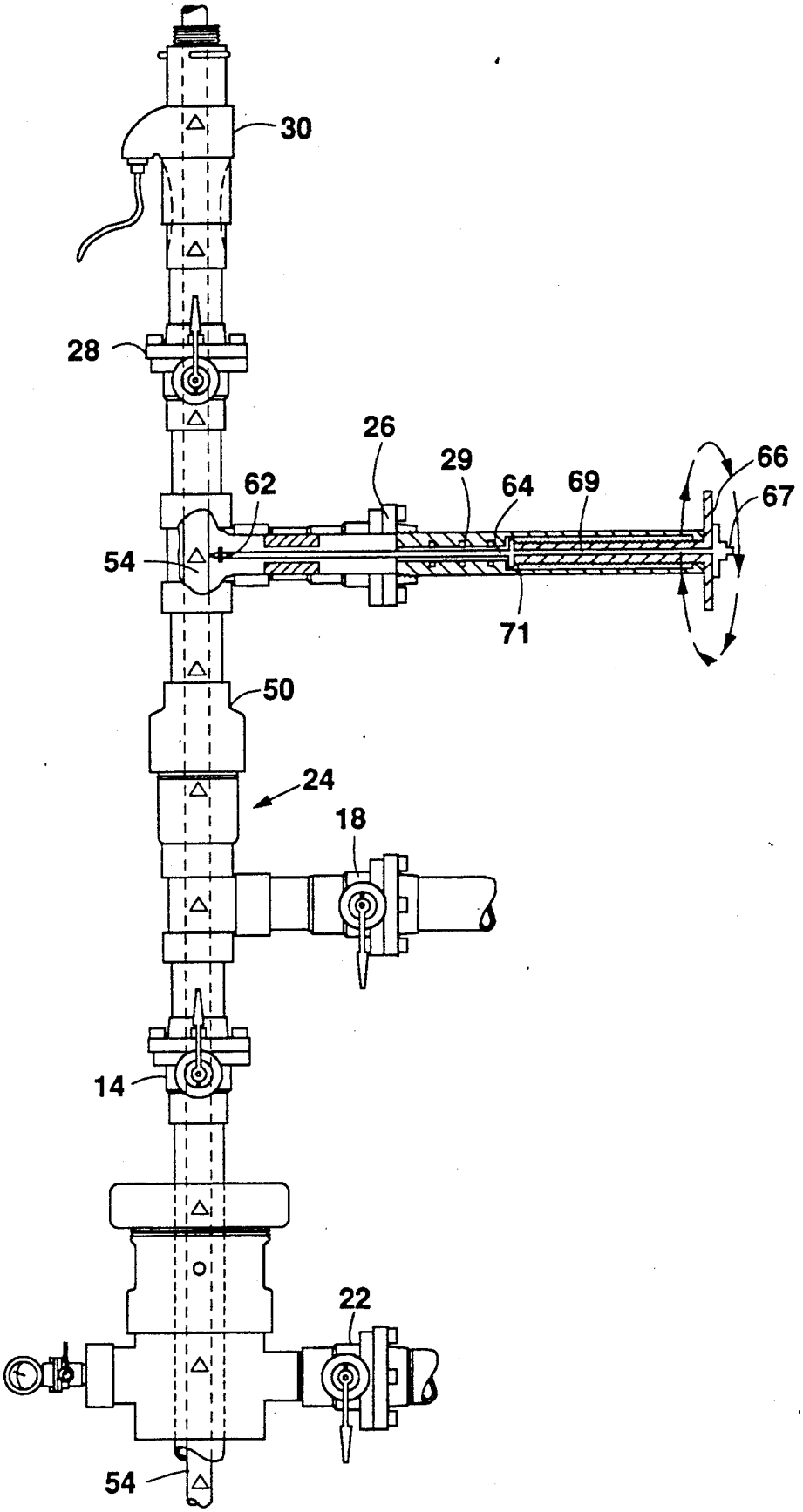
FIG. 10 illustrates the cutter of the present invention advanced and the hydraulic packoff closed.

As may be seen in FIG. 9, cutter housing 61 has seal grooves 29 for receiving and retaining seals (not shown) which seat against stem 64 in sealing engagement. In FIG. 10 cutter wheel 62 has been advanced to contact CT 54, and hydraulic packoff is closed to seal around CT 54. Cutter wheel 54 is forced into cutting engagement with CT 54 by securing stem 64 from rotating by holding its alignment nut 67 while turning handle 66. Internal threads on handle post 69 cooperate with threads on stem 64 to apply pressure to shoulder 71 on stem 64 to move it forward without twisting. Thus once cutter wheel 62 engages CT 54 and is aligned perpendicular to CT 54, cutter wheel 62 is not further twisted.

Figure 11:
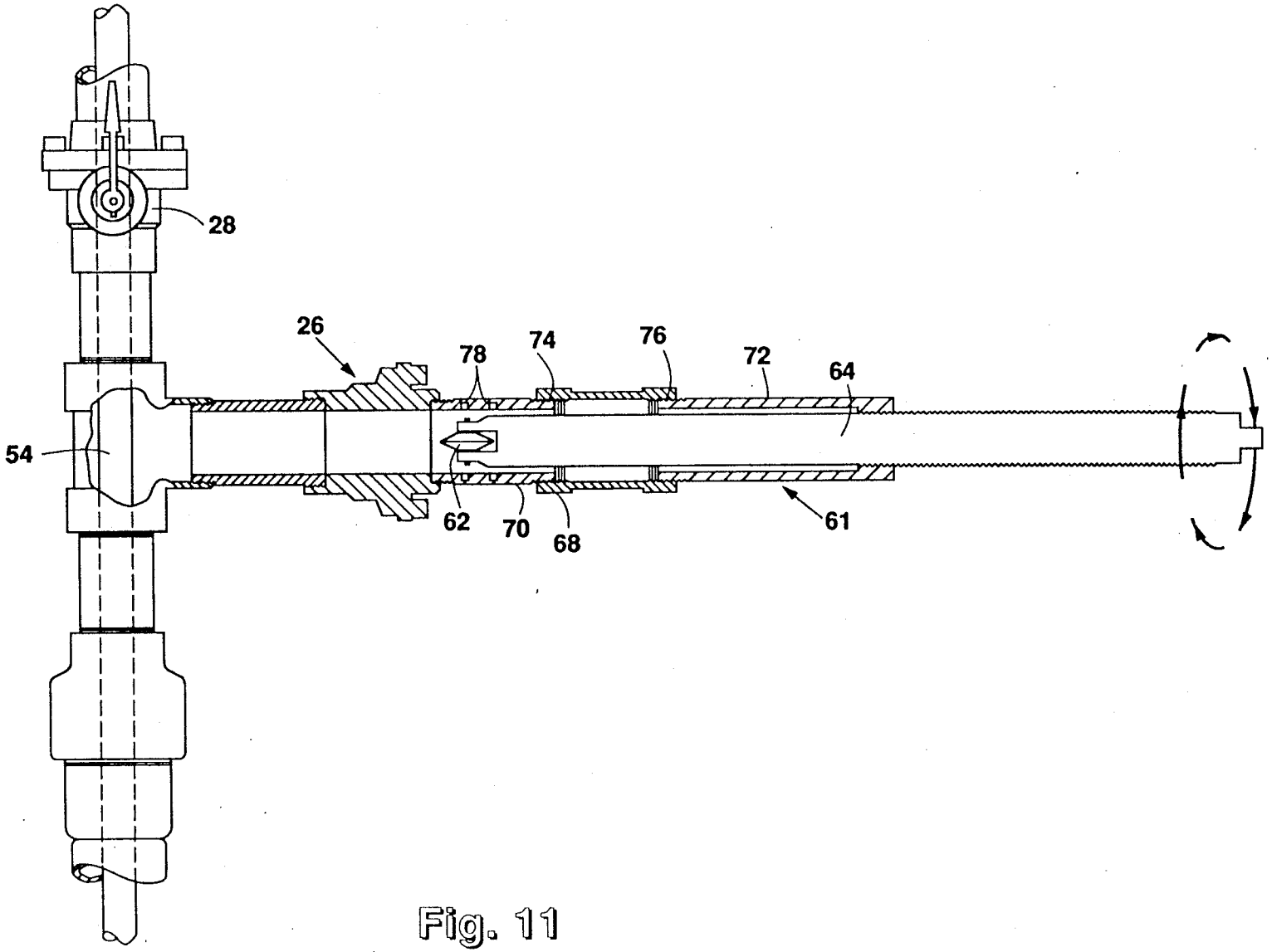
FIG. 11 illustrates in an alternative embodiment the cutter assembly of the present invention with the stem and cutter wheel withdrawn.

A more detailed illustration of an alternative cutter assembly 61 is shown in FIG. 11. Coupling 68 connects cutter assembly front end housing member 70 to cutter assembly back end housing member 72. Coupling 68 has left hand threads 74 on its front end for cooperation with threads on housing 70 and right hand threads 76 on its rear end for cooperation with threads on housing 72.

Figure 12:
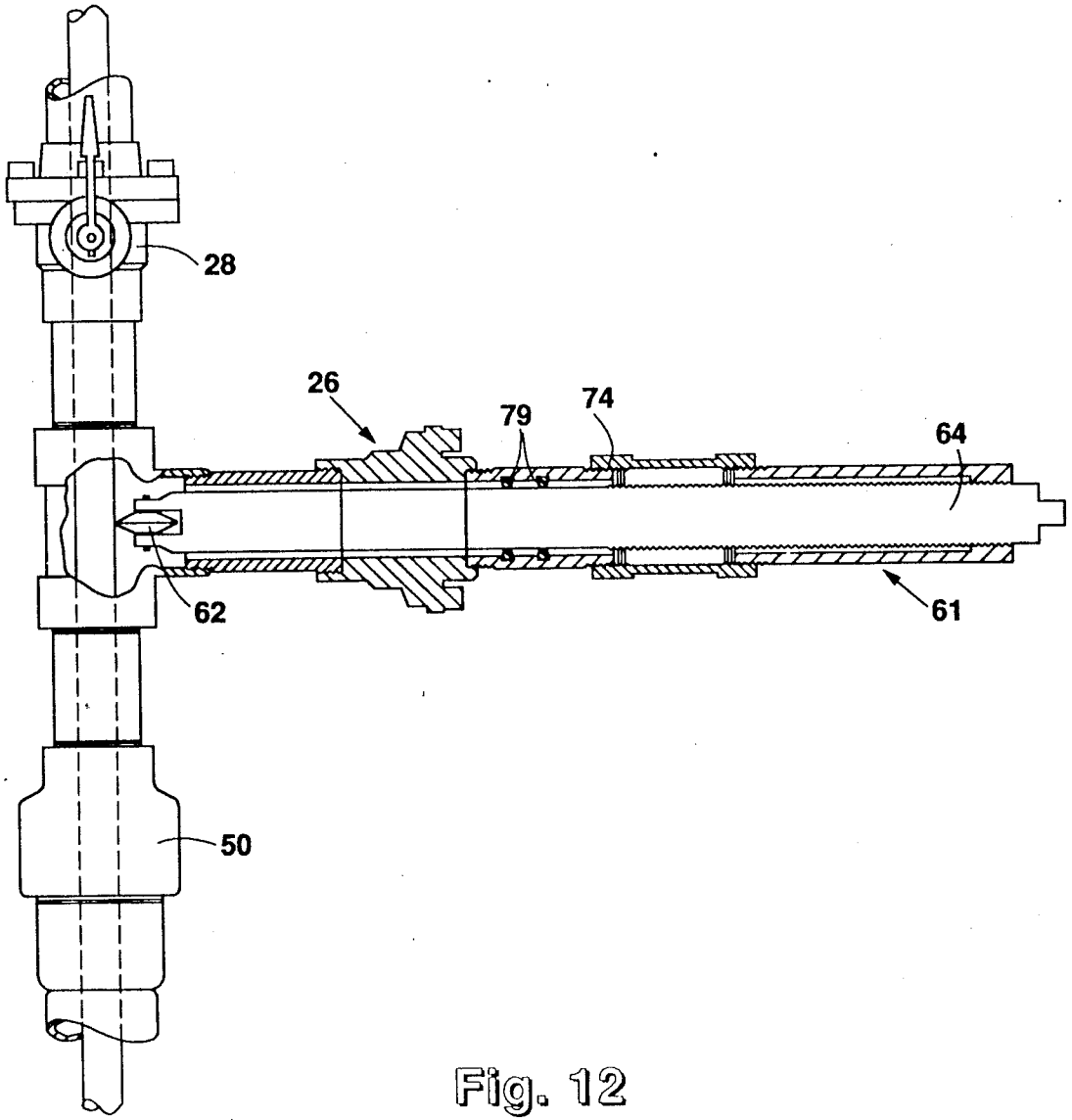
FIG. 12 illustrates the alternative embodiment of the cutter of the present invention advanced to contact the CT.

Cutter assembly front end member 70 is provided with seal grooves 78 for receiving and retaining seals (not shown in FIG. 11). The seals form a seal along cutter stem 64 as previously discussed with FIGS. 9 and 10 Rotation of stem 64 advances cutter wheel through valve 26 and into initial, perpendicular contact with CT 54. By rotating coupling 68 while holding stem 64 from rotation, cutter wheel 62 is forced into cutting engagement with CT 54 as is shown in FIG. 12 without any further twisting or misalignment. Seals 79 are shown in FIG. 12.

It must be understood that in both cases (FIGS. 10 and FIG. 12), the cutter wheel 62 is engaging a fully charged or "hot" CT run. The seals in the cutter assembly ensure that gas and fluid is not discharged to the environment when the cut into CT 54 is made. (The shading shown in FIGS. 11 and 12 is not intended to represent gas.)

Figure 13:
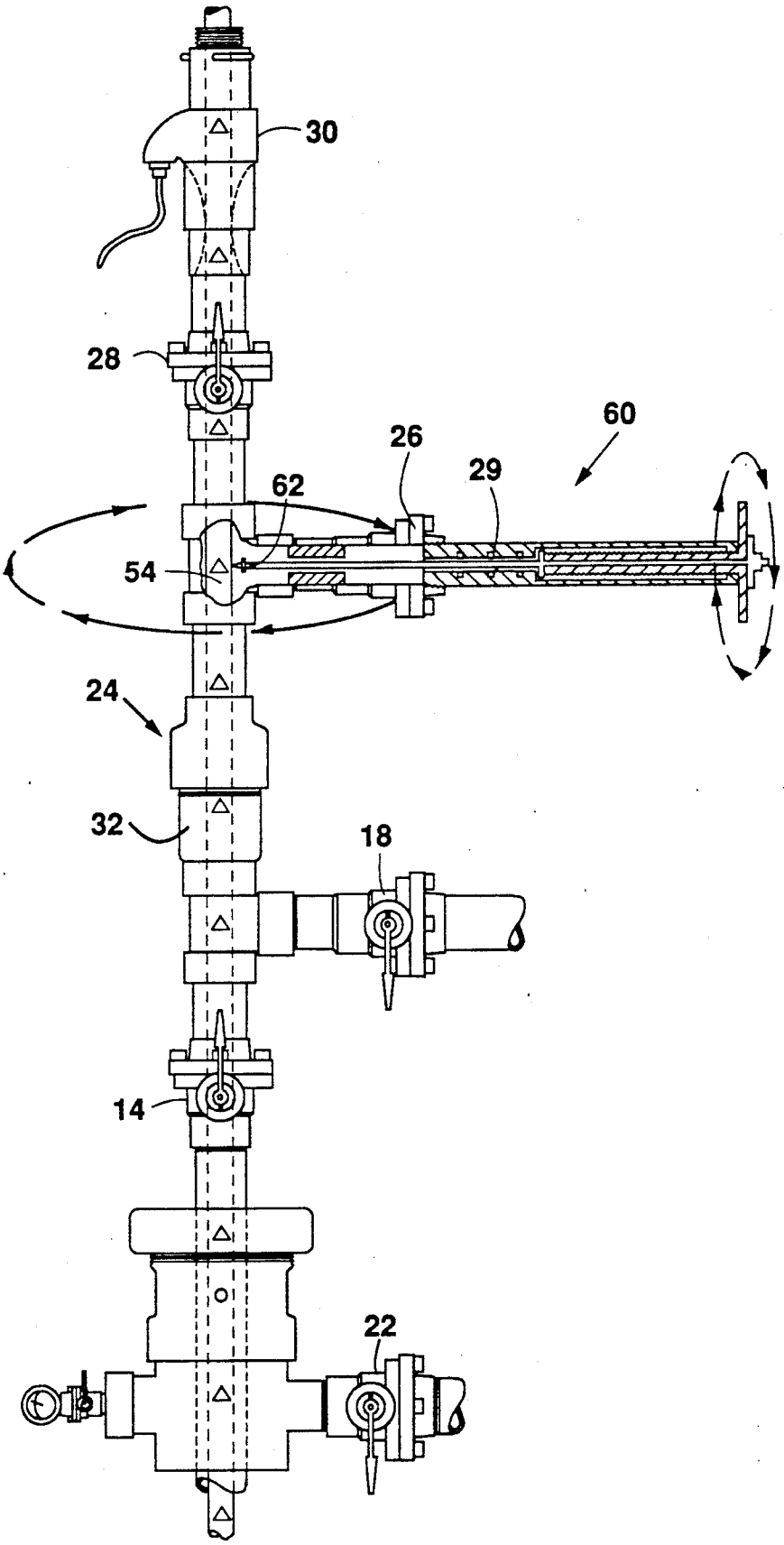
FIG. 13 illustrates the severing of the CT of the present invention.
Figure 14:
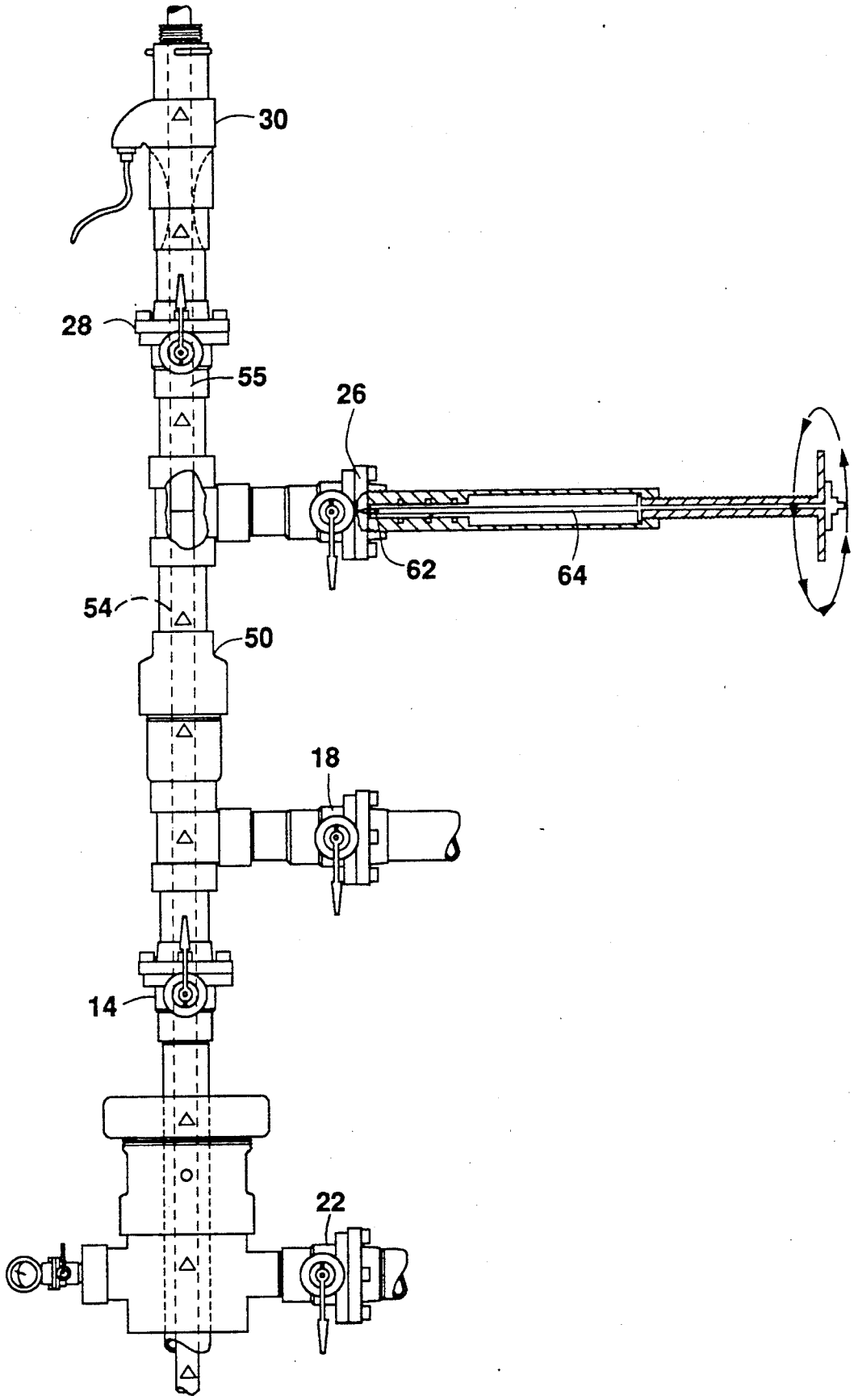
FIG. 14 illustrates the retraction of the cutter of the present invention.

In FIG. 13, cutter assembly 60 is rotated transverse of CT 54 and cutter wheel 62 presses into further cutting engagement to sever CT 54 by either turning handle 66 and securing alignment nut 67 (FIG. 10) or rotating coupling 68 while holding stem 64 from rotation (FIG. 12). Thus the entire hangoff assembly is charged with gas and fluid as a result of the rupture or severing of CT 54. Because hangoff head 24 including body 32 is constructed to take back pressure, the entire tap or cut is made safely. Hydraulic packoff 30 ensures that gas and fluid do not escape, while seals 79 in cutter assembly protect against gas leakage through cutter assembly 60, and back pressure O-ring 34 in head 24 prevents leakage through the hangoff.

Figure 15:
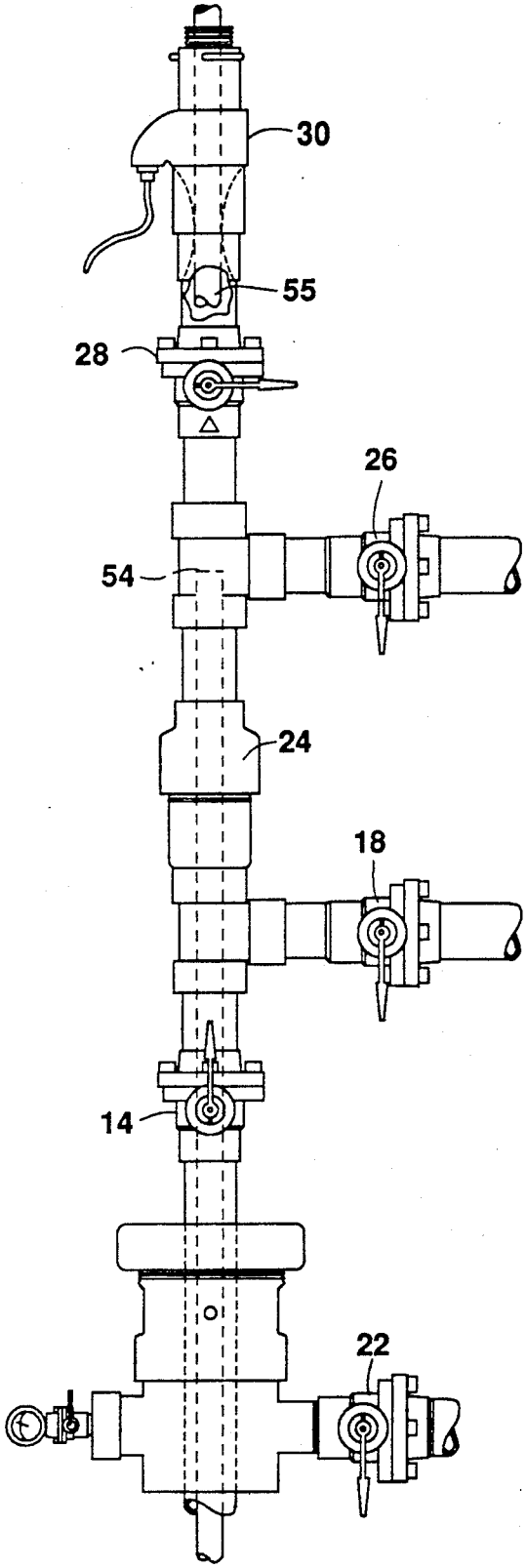
FIG. 15 illustrates the final removal of the CT and cutter assembly of the present invention.

Cutter stem 64 and wheel 62 are retracted in FIB. 14 and valve 26 is closed. Thus the "hot" tap is safely, quickly, and economically accomplished. Excess tube 55 may then be withdrawn through hydraulic packoff valve 30 and as tube 55 passes through top valve 28, valve 28 is closed (FIG. 15).

Figure 16:
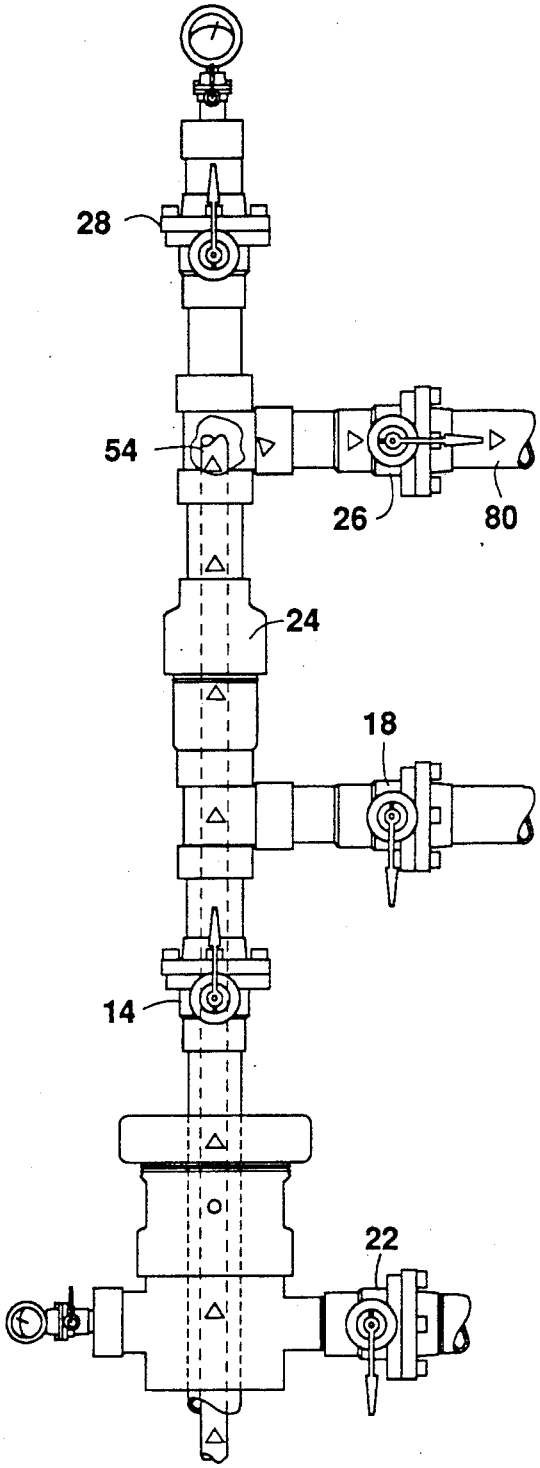
FIG. 16 illustrates the final well head configuration with CT velocity string installed.

FIG. 16 illustrates the final well head configuration with the CT velocity string installed and gas flowing through valve 26 and sales line 80.

While the invention has been described in connection with a preferred embodiment, it is not intended to limit the invention to the particular form set forth, but, on the contrary, it is intended to cover alternatives, modifications, and equivalents, as may be included within the spirit and scope of the invention a defined by the appended claims.

I claim:

1. A method for hanging off a coiled tube velocity string in an active gas production well tubing run, said run having at least a master valve and a first line valve, comprising the steps of:

installing a hangoff assembly in said production well tubing run between said master valve and said first line valve said hangoff assembly comprising a hangoff head, a second line valve, an upper valve, and a hydraulic packoff valve, said hangoff head further comprising a threaded body member, a slip bowl and a threaded cap;

inserting through said hydraulic packoff valve, said upper valve, and said hangoff head, coiled tubing for fluid communication with well gases and fluids in said production well tubing run, said coiled tubing having a first downhole end being open to immediately receive and conduct said gases and fluids;

opening gas and fluid communication between said production well tubing run and said open end of said coiled tubing whereby said well gases and fluid may pass up through said coiled tubing, said hangoff head sealing said gases and fluids from passing to said hydraulic packoff valve, said upper valve and said second line valve;

further inserting said coiled tubing to a desired depth in said production well tubing run;

rotating said cap of said hangoff head to expose said slip bowl;

inserting within said slip bowl slip members and packing to securely hold said coiled tubing at said desired depth and to seal around said coiled tubing;

reverse-rotating said cap of said hangoff head to close said hangoff head and to engage a means for sealing against subsequent back pressure leakage of said gases and fluids; said sealing means mounted on the outside of said body member;

connecting to said second line valve a means for severing said coiled tubing while said coiled tubing is charged with said well gases and fluids, said means for severing said coiling tubing sealing said gases and fluids from discharge to the environment through said means for severing;

closing said hydraulic packoff valve to seal around said coiled tubing passing therethrough;

severing said coiled tubing with said severing means into an upper excess coiled tubing portion and a lower coiled tubing velocity string portion;

withdrawing said upper excess coiled tubing portion back through said top valve;

closing said top valve to seal said gases and fluids from discharge through said top valve;

disconnecting and removing said upper excess coiled tubing portion and hydraulic packoff valve from said top valve;

closing said second line valve to seal said gases and fluids from discharge through said second line valve; and disconnecting and removing said means for severing from said second line valve.

* * * * *